US007568432B1

(12) United States Patent
Baker et al.

(10) Patent No.: US 7,568,432 B1
(45) Date of Patent: Aug. 4, 2009

(54) AGENT DEFEAT BOMB

(75) Inventors: James J. Baker, Waldorf, MD (US); Carl Gotzmer, Accokeek, MD (US); Robert Gill, White Plains, MD (US); Steven L. Kim, Crofton, MD (US); Matt Blachek, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/190,211

(22) Filed: Jul. 25, 2005

(51) Int. Cl.
*F42B 12/44* (2006.01)
*F42B 12/46* (2006.01)
*C06B 45/12* (2006.01)

(52) U.S. Cl. ..... 102/364; 102/517; 102/382; 149/14

(58) Field of Classification Search ..... 102/364, 102/365, 382, 473, 501, 517; 149/14, 15, 149/16

See application file for complete search history.

(56) References Cited

U.S. PATENT DOCUMENTS 3,865,035 A * 2/1975 Munson et al. ..... 102/364
H464 H * 5/1988 Lee et al. ..... 102/364
5,054,399 A * 10/1991 Bilek et al. ..... 102/481
5,266,132 A * 11/1993 Danen et al. ..... 149/15
5,505,799 A * 4/1996 Makowiecki ..... 149/15
5,852,256 A * 12/1998 Hornig ..... 102/473
6,283,036 B1 * 9/2001 Munsinger ..... 102/479
6,402,864 B1 6/2002 Gill et al.
6,679,176 B1 * 1/2004 Zavitsanos et al. ..... 102/364
6,691,622 B2 * 2/2004 Zavitsanos et al. ..... 102/364
6,945,175 B1 * 9/2005 Gotzmer et al. ..... 102/364
6,962,634 B2 * 11/2005 Nielson et al. ..... 149/19.3
7,278,353 B2 * 10/2007 Langan et al. ..... 102/306
7,278,354 B1 * 10/2007 Langan et al. ..... 102/306

* cited by examiner

*Primary Examiner*—James S Bergin
(74) *Attorney, Agent, or Firm*—Fredric J. Zimmerman

(57) ABSTRACT

An agent defeat bomb including a payload with at least one metal-based high thermal component, effective for producing high temperature, and a plurality of oxidizer components, such that the high thermal component and oxidizer are progressively stacked through the length of the projectile and react within the body of the bomb.

25 Claims, 1 Drawing Sheet

AGENT DEFEAT BOMB

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention primarily pertains to weapon systems useful in neutralizing biological, chemical and convention munitions, and their manufacturing and storage facilities. More particularly, the present invention provides for an effective payload configuration for neutralization weapon systems.

BACKGROUND

Weapon systems have been designed to effectively destroy myriad types of targets. Most of these systems have been designed with two criteria in mind. First, the weapon system must be able to reach the target. Second, the weapon system must then be able to destroy the target. However, in dealing with targets that contain chemical or biological agents, such as chemical and biological manufacturing and storage facilities, a third criteria must also be addressed. These chemical and biological agents must be destroyed in such a manner as to preclude or minimize the release of the chemical and biological agents outside the facility in order to minimize dispersal of these agents to avoid severe collateral damage.

While many current chemical and biological manufacturing and storage facilities are located above ground, these types of facilities may also be located in buried, fortified locations that are more difficult to reach or may not be reachable by conventional weapons systems due to their deeply buried hardened construction. Many weapon system concepts have been developed to address providing a means to enable a destructive payload to be delivered to these hardened deeply buried targets and other difficult to reach such targets. For example, U.S. Pat. No. 4,967,666 discloses a warhead that uses a forward hollow charge in order to create a passageway for an internal, follow-up projectile to be fired into fortified or armored targets. U.S. Pat. No. 5,780,766 discloses a similar type of "two-stage" device including an armor piercing hollow charge that clears a region or path for the missile to reach its final destination where, upon impact, a post-firing fragmentation explosive charge is released due to inertia. U.S. Pat. No. 5,526,752 discloses a projectile, which includes multiple warheads separated by casing with independent detonators where the warheads are detonated sequentially in order to penetrate the target. U.S. Pat. No. 5,939,662 discloses a missile warhead including a tungsten ballast to provide high warhead cross sectional density to increase pressure upon impact. Finally, U.S. Pat. No. 6,283,036 discloses a variable output warhead including several compartments separated by a shock-absorbing shield, each filled with explosive material where the shield prevents sympathetic detonation from one compartment to another. Depending upon the target, a specific number of compartments can be selected for initiation.

While these and other designs have provided some success in attacking hardened and deeply buried targets, none of these weapon systems address the need to destroy the final target in such a manner to minimize dispersal of chemical and biological agents as noted above. There have been systems designed to safely destroy chemical and biological agents. U.S. Pat. No. 6,011,193 describes a method to destroy chemical weapons by acid digestion. U.S. Pat. No. 6,354,181 describes a method and apparatus to destroy terrorist weapons by detonation of these weapons in a contained environment. However, these and other known methods were developed to destroy chemical and biological agents that are in the users' control and in some type of controlled and contained environment.

A weapon system that can penetrate both surface targets or soft targets and deeply buried hardened targets or hard targets containing chemical and biological agents and destroy these agents in such a manner to minimize dispersal of these agents to avoid severe collateral damage has been disclosed in commonly assigned U.S. patent application Ser. No. 10/463,882, filed on Jun. 18, 2003, entitled "A Biological and Chemical Agent Defeat System," such patent application is herein incorporated by reference. This application provided a kinetic energy penetrator warhead used to engage both surface and buried soft and hardened targets. The warhead contained a High Temperature Thermal Radiator (HTRR) fill capable of destroying chemical and biological agents in such a manner to minimize dispersal of these agents. Bomblets were incorporated into the warhead and ejected, with the HTTR fill, from the warhead in order to provide the means to open the chemical and biological agent containers and tanks to provide access to the chemical and biological agent to allow the product of the reaction of the warhead fill to react with and destroy said agents. Additionally, a guidance system was provided to direct the warhead to the target.

There is a need in the art to provide payload configurations for these, and other defeat weapon systems, to maximize their effectiveness. The present invention addresses this need and other needs. The present invention, alternatively, address needs to provide controlled burn applications, destroy unsafe structures and sanitize contaminated areas through use of the invention.

SUMMARY OF THE INVENTION

The present invention includes an agent defeat bomb for producing high temperatures and biocidal effect comprising a projectile including a payload with at least one metal-based high thermal component effective for producing high temperature and a plurality of oxidizer components, such that the high thermal component and oxidizer are progressively stacked through the length of the projectile and will react within the bomb body.

DETAILED DESCRIPTION

Figure 1:
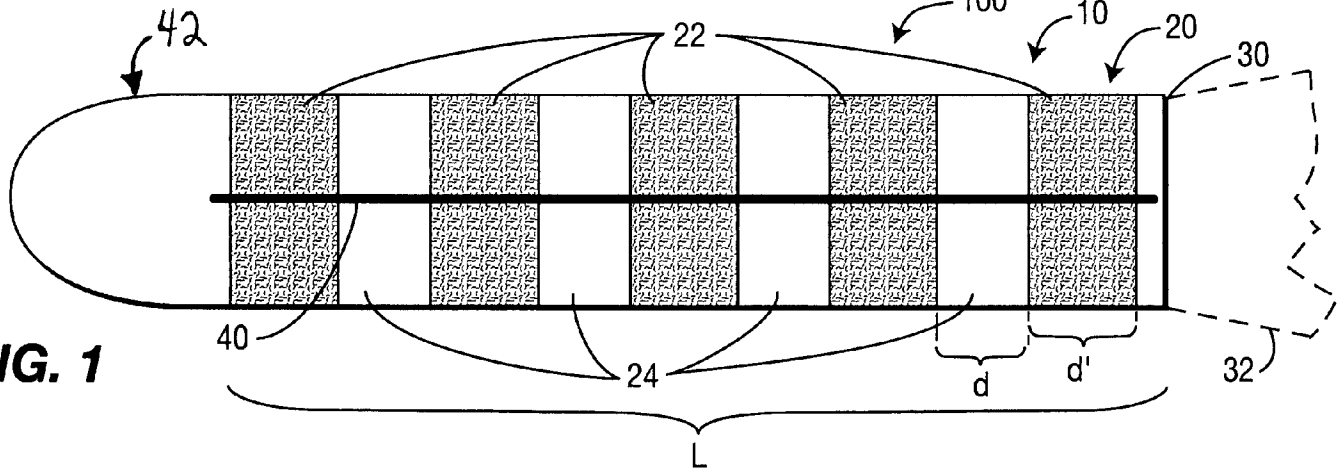
FIG. 1 illustrates an agent defeat bomb of the present invention.

The present invention includes a bomb comprising a projectile including a payload of at least one metal-based high thermal component for producing a high temperature together with numerous oxidizer components. These oxidizer components are progressively stacked with the high thermal component through the length of the projectile. This payload configuration is particularly useful in a weapon system for the neutralization of biological agents, such as, biological agents found in biological warfare munitions. The payload configuration of the present invention provides the neutralizing weapon system with the following features: (1) an improved payload for proper delivery, (2) an expanded payload per projectile, (3) an improved deployment of the payload when activated, (4) easier manufacture of the projectile, (5) and elimination of redundant material within the projectile. Additionally, the present invention provides a payload configuration and dispersing mechanism that further minimizes dispersal of these chemical and biological agents by eliminating the need for expulsion charges and their high pressure gasses. Nonetheless, the bomblets are still needed to open the tanks and containers to release the agents for subsequent destruction.

The present invention is useful within a weapon system that is capable of engaging both surface and buried targets that contain chemical and biological agents. The weapon system can also be used to engage surface and buried targets, which are sensitive to incendiary devices, such as, petroleum and fuel storage facilities, conventional weapons bunkers containing high explosive and blast fragmentation weapons and other targets. In engaging chemical and biological manufacturing and storage facilities, the agent defeat bomb efficiently destroys the chemical and biological agents in such a manner to minimize dispersal of these agents and ensure that collateral damage is also minimized by destruction of aerosolized agents.

The present invention, described herein, includes a payload for a weapon system, such as the system detailed in U.S. patent application Ser. No. 10/463,882, filed Jun. 18, 2003, for destroying chemical and biological agents within a structure. However, the present invention is designed to further minimize collateral damage resulting from the destruction of these agents. The novel payload configuration of the present invention is incorporated into a weapon system that generally includes a kinetic energy penetrator warhead, and, in particular, uses a precision guidance system. The payload of the present invention generates a two-stage thermal reaction by including an intermetallic high-temperature incendiary composition, which heats the target environment to high temperature through convective and radiant heat transfer, and a second oxidizer, which reacts and generates a biocidal product to defeat chemical and biological agents (CBAs) with minimum dispersal and escape of the CBAs from the target. The agent defeat bomb also includes a separation system 30, which separates a tail section 32 of the projectile 10 from a payload section 20 of the projectile to allow venting of the incendiary reaction of the combusting payload.

Figure 2:
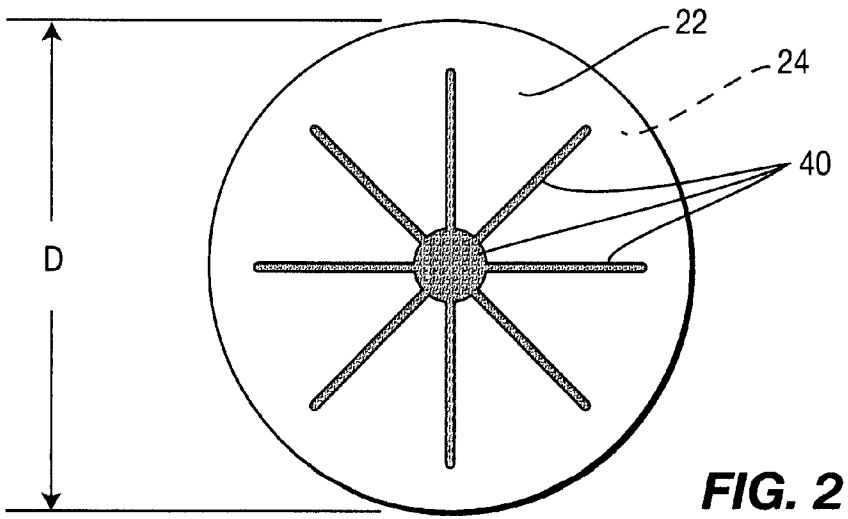
FIG. 2 illustrates a cross-sectional view of the agent defeat bomb shown in FIG. 1.

As seen in FIGS. 1-2, the present invention includes an agent defeat bomb 100 including a projectile 10 with the payload section 20 where the payload section 20 includes at least one metal-based high thermal component 22 effective for producing high temperature and a plurality of oxidizer components 24. In an exemplary embodiment, the high thermal component(s) 22 and oxidizer units 24 are progressively stacked into layers, that is, in a continuous series of layers either in contact or separated by a shock absorbing material, through a length (L) of the projectile 10 to maximize a radial burn efficiency of each individual layer. In another exemplary embodiment, the high thermal components 22 and oxidizer units 24 are progressively stacked in alternating layers, that is, in a continuous series of alternating layers, which may be separated by the shock absorbing material, through a length (L) of the projectile 10 to maximize a radial burn efficiency of each individual layer.

The projectile 10, in an exemplary embodiment, is incorporated as part of a weapon system, which includes a kinetic energy penetrator warhead 42. Kinetic energy penetrator warhead systems 42 are selected for the given payload section 20. In an exemplary embodiment, one type of kinetic energy penetrator warhead 42 is a 2,000 pound BLU-109 penetrator. In a second exemplary embodiment, another type of kinetic energy penetrator warhead 42 is a 1,000 pound J-1000 warhead. However, depending upon the target, various warheads can be used.

In another exemplary embodiment, the weapon system may also include a guidance system. Many warhead guidance systems exists and a system may be selected as long as it is capable of guiding the warhead to the target. In an exemplary embodiment, one type of guidance system includes a Joint Direct Attack Munition (JDAM) guidance kit. The JDAM employs a Global Positioning Satellite (GPS) updated inertial guidance concept to effect guidance of the target coupled with a movable tail control kit for aerodynamic control. This configuration retrofits existing bomb inventory including, but not limited to, Mk-84, 82 and 80 series bombs and BLU-109 bombs. Another guidance system example is a semi-active laser guidance system used in the Guided Bomb Unit-24. This system illuminates a target with a laser beam. The weapon guidance kit interprets the reflection of the laser energy from the target to provide steering commands to the canards on the nose of the bomb to effect aerodynamic control and steer the bomb to the target. Generally, the agent defeat bomb 100 is dropped from an aircraft using GPS satellites for guidance. Information is sent to the guidance system to guide the warhead to the target (generally, a structure housing tanks and/or containers of chemical and/or biological agents). Upon impacting the target, the separation system 30 separates the tail section 32 from the payload section 20. Vents are created within one or more parts of the bomb, such as, at the back of the bomb, the side of the bomb and combinations thereof.

In an exemplary embodiment, a tail section 32 is included in the weapon system. The separation system 30, which is capable of separating the tail section 32 from the payload section 20, is proximate as well as intermediate to the transition between the tail section 32 and the payload section 20. The separation system 30 separates the tail section 32 from the payload 20 to eliminate any excess pressure within the burning payload 20. Various separation systems 30 exist. In an exemplary embodiment, a separation system 30 including an explosive charge, for example, a linear shaped charge or an explosive ribbon charge cutting system, is located at a connection point of the tail section 32 and the payload section 20. A fuze (not shown) is used to initiate the explosive charge. This fuze is generally a time delay or void sensing fuze. The fuze will sense the impact through a structure, such as, a roof of a chemical or biological agent manufacturing plant, and initiate the explosive charge. The tail section 32 may be attached to the payload 20 through threads, a retaining ring and an aft closure mechanism. The separation system 30 allows the incendiary radiant and thermal heat of the combusting metal-based high thermal components 22 and oxidizer components 24 into the area of the munitions to be neutralized.

The payload 20, including a plurality of metal-based high thermal components 22 and oxidizer components 24, is, in an exemplary embodiment, cylinder-shaped with the kinetic energy penetrator 42 at one end of the payload section 20 and the tail section 32 at the other end. Within the payload 20, the plurality of metal-based high thermal components 22 and oxidizer components 24 are generally disk shaped inserts or canisters aligned within the interior of the payload 20 section. In an exemplary embodiment, the metal-based thermal components 22 and oxidizer components 24 are stacked in a configuration of alternating layers. This configuration includes a total of 3 to about 100 alternating components and, more particularly, 3 to about 20 alternating components, and, even more particularly, a total of about 5 to about 10 alternating components. The amount of metal-based high thermal component 22 to oxidizer component 24 is an amount effective for stoichiometric consumption of the chemical components and, in particular, in a ratio of thermal component 22 to oxidizer 24 of about 2:3, respectively, and more particularly, in a ratio of about 1:2 where the minimum number of thermal components is one (1) and oxidizer components 24 are two (2). In an exemplary embodiment, each of the metal-based thermal component 22 and the plurality of oxidizer components 24 includes a depth (d' and d, respectively), that is, a height, from about 2 inches to about 9 inches and, in particular, about 2 inches to about 6 inches. A minimum depth of about 2 inches is dictated by performance requirements. Each of the stacked metal-based thermal component 22 and plurality of oxidizer components 24 also includes a proper diameter (D) for standard aircraft missile systems or projectile casings, for example, and without limitation, a 5 inch diameter.

Additionally, as shown in FIG. 1, metal-based thermal components 22 are generally located at each end of the length (L) of the payload section 20. The metal-based thermal components 22 and oxidizer components 24, which are stacked, may be separated by a shock absorbing composition, such as, a crushable foam structure, situated in between each, or some, metal-based thermal component 22 and oxidizer component 24. In an exemplary embodiment, as seen in FIG. 2, the agent defeat bomb 100 includes an ignitor 40 substantially through a center portion of the metal-based high thermal components 22 and a center portion of the oxidizer components 24. For effectiveness, this ignitor 40 may be formed or filled into a particularly configured form or space, such as, a shape of a star, wagon wheel, and other like shapes used in solid rocket motors to boost surface area and lower burn times. In particular, the ignitor 40 includes a radiating star shape. Additionally, multiple holes may be used where the holes include similar shapes or round shapes.

Referring to FIGS. 1 and 2, the metal-based high thermal components 22, through reaction, produces convective heating, thermal radiation, and a biocide in order to defeat both chemical and biological agents (CBAs) while minimizing dispersal of these agents. The metal-based high thermal components 22 are each generally comprised of an intermetallic composition, which generates heat to react with the oxidizer 24, such as, lithium perchlorate or sodium chlorate. The oxidizer 24 provides oxygen to generate oxides of the intermetallic constituents, which causes the release of additional heat. Representative unitized metal-based high thermal components 22, include, for example and without limitation, metals, such as, titanium, aluminum, magnesium, lithium, boron, beryllium, zirconium, thorium, uranium, hafnium, alloys thereof, hydrides thereof, and combinations thereof. In an exemplary embodiment, the metal-based high thermal components 22 include a mixture of titanium and boron fuel as described in U.S. Pat. No. 6,402,864 to Gill et al., entitled Low Slag, Reduced Hazard, High Temperature Incendiary, the disclosure of which is herein incorporated by reference.

Generally, these intermetallic compositions of metal based high thermal components 22 generate a thermal impulse within the target volume. The thermal impulse includes a maximum temperature, which exceeds 400 degrees Fahrenheit and, more particularly, from about 750 degrees to 1,500 degrees Fahrenheit, which is adjusted based upon the size of the target engaged in order to destroy the agent from the high heat generation. Accordingly, CBAs are destroyed at least when the ambient temperature exceeds the normal temperature range in which the CBAs can exist and/or from agent (CBA) combustion.

The overall two-stage reaction generally creates over 6,200 calories per cubic centimeter of reactants with the reaction's adiabatic flame temperature in an order of 6,500 degrees to 7,000 degrees Fahrenheit. The thermal impulse of the reaction maintains high-temperatures for extended periods of time to ensure complete destruction of the chemical and biological agents by at least direct killing of the biological agents, disruption of at least one metabolic functions in the biological agent critical to the agents survival, and/or combustion of the biological or chemical agent where the agent undergoes oxidization in a combustion process. In an exemplary embodiment, a thermal profile includes a thermal impulse burning rate of over 400 degrees Fahrenheit from less than about one minute to several minutes and, in particular, over at least five seconds, and more particularly, over one minute, and still more particularly, greater than three minutes, and most particularly, greater than five minutes. In an exemplary embodiment, the thermal impulse of the combustion of the payload 20 provides low-overpressure normally in a range of about 0.2 to about 0.5 psi, in order to ensure minimal dispersion of the chemical and biological agents during defeat.

The oxidizer 24 may include any appropriate oxidizer for agent defeat purposes. In an exemplary embodiment, the oxidizer 24 includes a perchlorate material or a chlorate material. Representative oxidizers 24 include, for example and without limitation, lithium perchlorate, lithium chlorate, magnesium perchlorate, magnesium chlorate, ammonium perchlorate, ammonium chlorate, potassium perchlorate, potassium chlorate, sodium chlorate, sodium perchlorate and combinations thereof. Representative perchlorates include, for example and without limitation, potassium perchlorate ($KClO_4$), lithium perchlorate ($LiClO_4$) and sodium chlorate ($NaClO_2$). In an exemplary embodiment, lithium perchlorate is used. The selection of a perchlorate/chlorate for the oxidizer 24 enables the generation of chlorine, which is a biocide, as one of the products of reaction. In addition, certain metal compounds, such as, $TiO_2$, are known for their biocidal properties. The combination of $TiO_2$ and halogen gas are particularly effective on biological agents. Additionally, a halogenated compound, such as, Teflon, or a halogenated binder, such as, a polyfluoro binder, may be included in the oxidizer 24, or the metal-based high thermal components 22. The halogenated compound or binder, when used, provides a halogen gas, for example and without limitation, fluorine, as a product of the combustion reaction, which acts as a biocide.

The oxidizer 24 generally generates a biocide during the reaction with the metal-based high thermal component 22, such as, halogenated compounds, including chlorine, fluorine, bromide or their acid derivatives. Additionally, a payload generally within the oxidizer 24 may also contain additives to further generate biocidal compositions. These additives may include a halogen generating composition, such as, metal chlorides, iodides, fluorides, bromides or combinations thereof. In particular, examples of biocides include those mentioned above, such as, halogenated compounds, including chlorine, fluorine, bromide or their acid derivatives. These halogenated compounds may be mixed into the oxidizer 24 or placed in separate wafer(s) at the exit of the device.

Within the present invention, the metal-based high thermal components 22 and oxidizer composition 24 are combined in a manner that allows the components to react within the body of the agent defeat bomb.

EXAMPLE 1

Prophetic

A defeat agent bomb is constructed to include a payload diameter of about 5 inches with a total of 5 titanium/boron disks, for example, each disk including a depth of about 2 inches, which is adjacent to four (4) potassium perchlorate oxidizer disks, for example, each disk including a 5 inch diameter and a 3 inch depth. The titanium/boron disks are stacked to provide a titanium/boron disk at each end of the stack so that no disks are adjacent to other like composition disks. An ignitor mix of Viton® A, $Fe_3O_4$, and aluminum powder is inserted through the entire length of the stack of disks in a star shape. Viton® is a fluoroelastomer manufactured by DuPont-Dow Elastomers of Geneva, Switzerland.

Titanium and boron react to form titanium diboride generating about 1.2 kcal/gm with a reaction temperature of about 3,500° K. Reaction of the hot titanium diboride particles with the potassium perchlorate oxidizer provides the formation of such biocides as chlorine, fluorine, the acids of chlorine and fluorine, and titanium dioxide. Additionally, a biocide of titanium dioxide ($TiO_2$) is formed when the titanium/boron alloy reacts with the oxidizer.

EXAMPLE 2

Prophetic

Example 1 is repeated except that the mixture of titanium and boron is replaced with the titanium boron fuel, including Boron powder (about 14.25% by weight) Titanium powder (about 60.75%), CTBN polymer (about 2.35%), Dioctyl adapate (DOA) (about 1.30%), Lecithin (about 1.00%), Stannous octoate (about 0.04%), Epoxy ERL-0510 (about 0.31%) and Teflon powder (about 20.00%) in a unit that is 12 inches in diameter.

EXAMPLE 3

Prophetic

Example 1 is repeated except that there are 9 titanium boron fuel disks and 8 sodium perchlorate disks. The unit is 12 inches in diameter.

EXAMPLE 4

Prophetic

Example 1 is repeated except that there are 5 titanium boron fuel disks and 4 lithium perchlorate disks, each disk including a 5 inch diameter.

EXAMPLE 5

Prophetic

Example 3 is repeated except that aluminum trichloride wafers are placed at the exit of the unit, which decomposes on combustion to yield additional chlorine biocide.

EXAMPLE 6

Prophetic

Example 3 is repeated except that wafers of a mixture of lithium perchlorate and aluminum trichloride are placed at the exit of the unit, with the oxygen from the perchlorate reacting with the aluminum to releasing additional chlorine biocide during combustion.

EXAMPLE 7

Prophetic

A sub-scale candle including about 1.5 pounds of reactive material with a ratio of about three (3) parts oxidizer to about two (2) parts titanium boron fuel is ignited within a 30 cubic feet concrete container. The container includes two (2) vent holes where one (1) hole is about 11"×7", and the other hole is about 2" in diameter. The temperature within the chamber exceeds 400° F. for 15 seconds with an average temperature of 420° F.

The foregoing summary, description, and examples of the present invention are not intended to be limiting, but are only exemplary of the inventive features, which are defined in the claims.

Additional advantages and modifications will readily occur to those skilled in the art upon reference to the disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A bomb for producing high temperatures and biocidal effect, comprising:

a projectile comprising a payload, wherein said payload is a two-stage thermal reaction system comprised of a plurality of metal-based high thermal components effective for producing high temperature, and a plurality of oxidizer components, wherein the plurality of metal-based high thermal components and the plurality of oxidizer components are progressively stacked in component layers through a length of the projectile, and wherein the component layers comprise a plurality of a continuous repeating series of layers, an igniter being position through center portions of the plurality of metal-based high thermal components and the plurality of oxidizer components for igniting said two-stage thermal reaction system.

2. The bomb of claim 1, wherein the ignitor includes a configuration selected from at least one of a radiating star, wagon wheel, round, and multiple holes.

3. The bomb of claim 1, further comprising a separation system for releasing through a vent created within the bomb, wherein the vent is formed in a location selected from at least one of a back portion of the bomb and the side of the bomb.

4. The bomb of claim 3, wherein each the plurality of metal-based high thermal components is comprised of a titanium and boron combination.

5. The bomb of claim 1, wherein each of the plurality of metal-based high thermal components are selected from at least one of titanium, aluminum, magnesium, lithium, boron, beryllium, zirconium, thorium, uranium, hafnium, alloys thereof, and hydrides thereof.

6. The bomb of claim 1, wherein the plurality of metal-based high thermal components are configured to react over a period of time of about less than 1 minute.

7. The bomb of claim 1, wherein the plurality of metal-based high thermal components and the plurality of oxidizer components are configured to react within a body of the bomb.

8. The bomb of claim 1, wherein the plurality of oxidizer components are selected from at least one of lithium perchlorate, lithium chlorate, magnesium perchlorate, magnesium chlorate, ammonium perchlorate, ammonium chlorate, potassium perchlorate, potassium chlorate, sodium chlorate, and sodium perchlorate.

9. The bomb of claim 1, wherein the plurality of oxidizer components comprise lithium perchlorate.

10. The bomb of claim 1, wherein the plurality of metal-based high thermal components and the plurality of oxidizer components comprise a total of 3 to about 100 components.

11. The bomb of claim 1, wherein the plurality of metal-based high thermal components and the plurality of oxidizer components comprise a total of about 5 to about 10 components.

12. The bomb of claim 1, wherein each layer the plurality of metal-based high thermal components and the plurality of oxidizer components are separated from another layer a shock absorbing composition.

13. The bomb of claim 12, wherein the shock absorbing composition comprises a crushable foam structure.

14. The bomb of claim 1, wherein an amount of the plurality of metal-based high thermal components to the plurality of oxidizer components is in a predetermined ratio of about 2:3.

15. The bomb of claim 1, wherein each of the plurality of oxidizer components comprises a depth of about 2 inches to about 9 inches.

16. The bomb of claim 1, wherein the payload further comprises an additive selected from at least one of metal chlorides, iodides, fluorides, and bromides.

17. A biocide product produced by ignition of the bomb of claim 1.

18. The biocide product of claim 17, wherein the biocide produced is selected from at least one of chlorine, fluorine, bromine, iodine, acids thereof, and $TiO_2$.

19. The bomb of claim 1, wherein the payload comprises two end portions, and wherein one of the plurality of metal-based high thermal components is at least located at each of the two end portions.

20. The bomb of claim 1, wherein said projectile includes an adiabatic flame temperature in a predetermined temperature range of about 6,500 to about 7,000 degrees Fahrenheit.

21. The bomb according to claim 1, herein said projectile further comprises a separation system and a tail section.

22. The bomb according to claim 21, wherein said separation system is situated intermediate said payload and said tail section.

23. A bomb for producing high temperatures and biocidal effect, comprising:

a projectile comprising a payload, wherein said payload is a two-stage thermal reaction system comprised of at least on layer comprised of a metal-based high thermal components effective for producing high temperature, and an oxidizer components, and wherein said at least one layer is stacked through a length of the projectile, and wherein said at least one layer is a continuous layer of alternating said metal-based high thermal component and said oxidizer component, an ignitor being position through a center portion of the metal-based high thermal component and the oxidizer component for igniting said two-stage thermal reaction system.

24. The bomb of claim 23, wherein the metal-based high thermal component comprises a depth of about 2 inches to about 6 inches.

25. The bomb of claim 23, wherein said projectile is a two-stage thermal reaction projectile with an adiabatic flame temperature.

* * * * *